United States Patent [19]

Stegmeier

[11] 3,967,422

[45] July 6, 1976

[54] DISPOSABLE MOLD FORM AND METHOD OF MOLDING

[76] Inventor: William J. Stegmeier, 878 Erickson Road, Concord, Calif. 94520

[22] Filed: Sept. 23, 1968

[21] Appl. No.: 761,726

[52] U.S. Cl. ..... 52/169 R; 249/2; 249/DIG. 3; 249/19

[51] Int. Cl.[2] ..... E04B 1/34; E04G 17/00

[58] Field of Search ..... 249/10, 29, 19, 134, 249/189, DIG. 3, 2; 25/118 W, 131 B, 131 D, 131 P; 117/68.5; 52/102, 274, 309, 169

[56] References Cited

UNITED STATES PATENTS

| | | | |
|---|---|---|---|
| 2,937,065 | 5/1960 | Harza | 249/10 UX |
| 3,076,230 | 2/1963 | Parker | 249/134 X |
| 3,124,905 | 3/1964 | Steir | 52/102 X |
| 3,186,679 | 6/1965 | Williams | 249/134 |
| 3,257,677 | 6/1966 | Batchelder | 117/68.5 X |
| 3,348,801 | 10/1967 | Deason | 25/118 W X |
| 3,350,049 | 10/1967 | Reiland | 249/134 X |
| 3,408,786 | 11/1968 | Snyker | 52/309 |
| 3,515,779 | 6/1970 | Jones | 249/134 X |

*Primary Examiner*—John E. Murtagh
*Attorney, Agent, or Firm*—C. Michael Zimmerman

[57] ABSTRACT

A disposable mold form for use in constructing a concrete coping along the upper edge of a swimming pool, and a method of molding such coping. The disposable mold form comprises a plurality of elongated form sections each having a surface portion configurated in the finished shape to be imposed thereby upon the coping, and each having also an attachment portion adhesively attachable to the vertical walls of such pool adjacent the upper edges thereof. Each form section is lightweight, sufficient stiff to confine a moldable mass of concrete spread thereagainst, and bendable along the length thereof to enable it to conform to either inside or outside arcuate corners along such vertical walls of the pool. In the method of molding a concrete coping, the side walls of the pool are first covered with tile or other water-impervious finish, one face of a double-faced pressure-sensitive tape strip is secured to the attachment portion of each form section which is then adhesively secured by means of the other face of such tape strip to the finished surface of the pool walls with the configurated surface portions of the form sections projecting thereabove. A seal element is positioned along the upper edges of the pool walls in overlying relation with the water-impervious finish thereof, and a moldable mass of concrete is then spread against the form sections. Upon curing of the concrete mass, each form section is stripped from its adhesive attachment to the water-impervious surface of the pool walls to uncover the coping.

12 Claims, 5 Drawing Figures

INVENTOR.
William J. Stegmeier
BY
Gardner & Zimmerman
ATTORNEYS

DISPOSABLE MOLD FORM AND METHOD OF MOLDING

This invention relates generally to the construction of swimming pools and the like and, more particularly, to a method of and disposable mold form for molding a concrete coping along the upper edge of a swimming pool.

In constructing a concrete swimming pool, the commonly followed practice is to first build the upwardly extending concrete side walls and bottom wall therefor usually as an integer and by a technique known as the gunite process. After the concrete side walls have at least partially cured, wooden strips (sometimes referred to as ledgers and which are often 2 × 6's) are nailed directly to the side walls along the upper edges thereof, and then face strips (often wooden 1 × 6's) are nailed to the ledgers and extend upwardly therefrom and define a mold therewith adapted to confine a mass of moldable concrete spread thereagainst which, when cured and the face and ledger strips removed, defines a coping extending inwardly from and overhanging the upper edge of the pool side walls. Thereafter, the tile or other water-impervious finish for the side walls is secured to the inner surfaces thereof, and grout is interposed between the upper edge of such tile and the overhanging coping. Finally, a rubber fillet is positioned in the corner defined along the grout so as to enclose such corner and make the same substantially water-tight.

It may be noted that the upwardly extending side walls of a water filled pool experience little thermal expansion or contraction since they are almost completely immersed within the body of water confined within the pool and are therefore maintained at a relatively uniform temperature. In contrast, the concrete coping at the top of the pool is almost continuously experiencing thermally-induced expansion or contraction because it is exposed directly to the ambient atmosphere and its temperature therefore varies with changes in ambient conditions. As a consequence, there is relative expansion and contraction between the side walls of the pool and the coping thereof, and the common fabrication practice explained attempts to accommodate such relative movement along the juncture of the side walls and coping while still providing a water-tight seal therealong by the use of grout and the rubber fillet thereover. It will be evident that both the grout fill and exposed rubber fillet are subject to cracking, wherefore the juncture protected thereby is prone to permit water seepage. It is also apparent that the shape of the coping is rather difficult to change unless expensive and specially constructed wooden forms are provided.

In view of the foregoing, an object, among others, of the present invention is to provide an improved mold form for and method of molding a coping along the upper edges of the generally vertical side walls of a swimming pool or the like.

Another object of the invention is that of providing a lightweight, inexpensive mold form which can be adhesively secured to the side walls of a pool and is sufficiently low cost that it is disposable upon being stripped from the pool walls and coping after curing of the concrete confined by the mold form and constituting the pool coping.

Still another object is in the provision of a disposable mold form comprised of a plurality of form sections which are substantially identical and each of which is made from a lightweight, inexpensive material such as the synthetic plastic sold under the trademark Styrofoam, or some like material, which is sufficiently stiff to confine a moldable mass of concrete spread thereagainst, and at the same time is sufficiently bendable to enable it to conform to arcuate corner portions along the side walls of the pool irrespective of whether such corner portions have inside or outside curvatures.

Yet another object is to provide a mold form section as described which is readily configurated in an attractive shape so that the finished appearance of the coping can be made to blend with and cntribute to the esthetic appearance of the entire pool.

A further object of the invention is that of providing an improved joint between the upwardly extending side walls of a pool and the coping therealong, and which joint is substantially sealed against penetration by moisture and automatically accommodates and compensates for any slight variations in elevation and surface flatness of the upper edge of the pool side walls where they meet the coping to define such joint.

Still a further object is in the provision of an improved method of molding a concrete coping along the upper edge of a swimming pool or the like, and which method enables the water tile or other water-impervious finish to be secured to the upwardly extending side walls of the pool before the coping is formed therealong, thereby resulting in a more attractive appearance, better fit of the coping, elimination of the requirements for grouting and the necessity of a rubber fillet, and also resulting in a long lasting substantially water-tight seal being effected between the walls and coping.

Yet a further object is to provide a method of forming a coping along the upper edge of a swimming pool and which method includes extending a double-faced, substantially non-stretchable pressure-sensitive tape strip along the attachment portion of a structurally stable, bendable form section as heretofore described, adhesively securing the same by means of the opposite face of the tape strip to the water-impervious finish of the pool side walls, and laying a resilient seal along the upper edge of the side walls and against the form section in overlying relation with the moisture-impervious finish on the side walls, thereby accommodating any irregularities along the upper edge of the side walls and moisture-impervious finish thereon as respects the concrete coping thereafter spread against the form section.

Additional objects and advantages of the invention, especially as concerns particular features and characteristics thereof, will become apparent as the specification develops.

An embodiment of the invention is illustrated in the accompanying drawing, in which.

Figure 1:
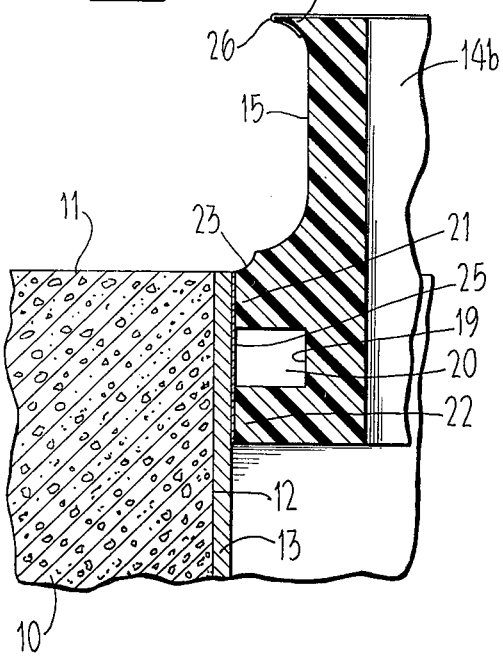
FIG. 1 is a broken vertical sectional view showing an upper inner edge portion of the side wall of a pool with a mold form embodying the invention in position therealong.
Figure 2:
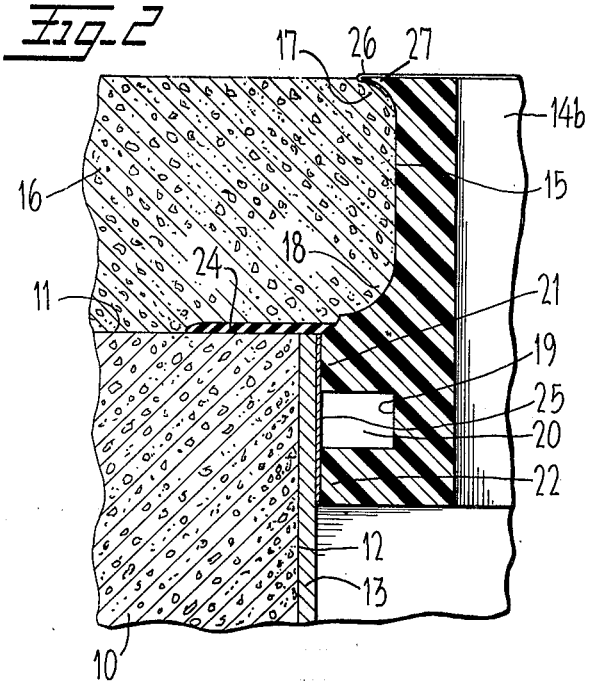
FIG. 2 is a broken vertical sectional view, similar to that of FIG. 1, but showing the wall portion after the coping-defining concrete mass has been spread against the form.

As respects the present invention, the upwardly extending side walls and bottom wall of the swimming pool may be formed in any conventional manner, and ordinarily are fabricated of concrete, as shown. The generally vertical or upwardly extending walls may be enlarged somewhat at their upper ends to form a bond beam which is rather standary practice. By way of example, the concrete side walls of the pool may have a thickness of about four inches throughtout most of their extent but which enlarges to about 11 inches in thickness for a depth of approximately one foot along the upper edges thereof to define such beam thereat. The portion of the pool wall illustrated in FIGS. 1 and 2 is denoted in general with the numeral 10, and it has an upper edge 11 and an inner face or surface 12. The face 12 has a water-impervious finish 13 secured thereto which may be ceramic tile attached to the face in any usual manner as, for example, by means of adhesive or concrete bed mud. As stated hereinbefore, as respects these features and characteristics of the pool, they may be completely conventional and per se form no part of the present invention.

Figure 3:
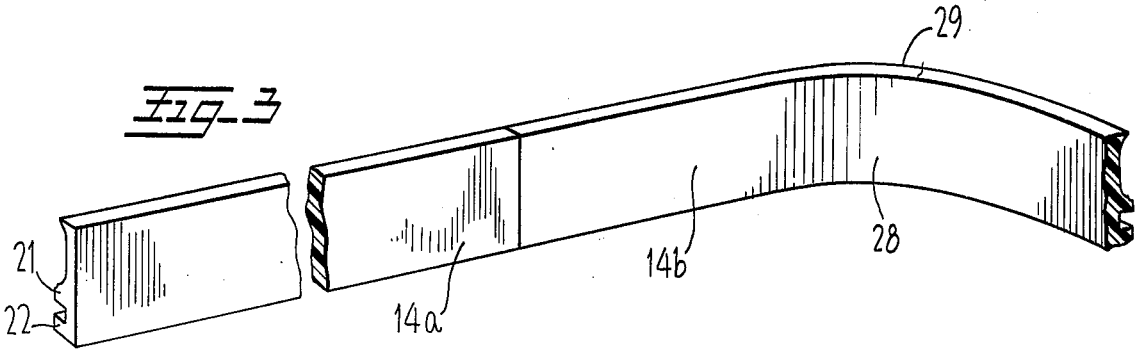
FIG. 3 shows a pair of mold form sections one of which has been bent to conform it to an inside arcuate corner portion of a pool side wall.

Secured to the upwardly extending walls 10 of the pool adjacent the upper edge 11 thereof is a disposable mold form comprising a plurality of form sections which are identical except that certain of the sections may be bent so as to conform to any curvatures and corner portions located along the side walls of the pool. In FIG. 3 two such sections are shown, one of which is substantially straight or linear and the other of which has an inside bend formed therealong. For purposes of differentiation, these form sections are respectively denoted 14*a* and 14*b*, and in FIGS. 1 and 2 the section there shown has an inside bend formed therealong and may be considered to be the form section 14*b*.

Each of the form sections 14 is integral from end to end thereof, is elongated longitudinally, and in a typcial instance is provided in a length of about nine feet. Each form section is lightweight and may be formed of a material having myriad interstitial spaces therein as, for example, one of the synthetic plastics such as the plastic material sold under the trademark Styrofoam. Each section 14 has a surface portion 15 configurated in the finished shape to be imposed thereby upon a coping molded thereagainst as shown in FIG. 2 and which coping is denoted with the numeral 16. The configurated surface portion 15 has a reversely oriented, somewhat C-shaped disposition in cross section so that the coping 16 has slightly rounded top and bottom edge portions 17 and 18, respectively.

Each section 14 further has an attachment portion, generally denoted 19, which faces in the same direction as that of the configurated surface portion 15, and is provided centrally with a longitudinally extending channel 20 defining a pair of vertically spaced ribs or feet 21 and 22 adapted to be attached to the tile or finish 13, as described hereinafter. Along the juncture of mergence of the configurated portion 15 with the attachment portion 19, each section 14 has an arcuate recess 23 extending longitudinally therealong which is adapted to seat an edge portion of a resilient seal 24 therein, as shown in FIG. 2.

In order to indicate the general order of size of the mold form sections 14, in the specific instance thereof referred to hereinbefore in which each section has a length of about nine feet, it may have a thickness of about two inches at the rib-equipped attachment portion 19 thereof and a height of approximately six inches with about four inches thereof projecting above the upper edge 11 of the pool side wall 10. The form sections 14 may be fabricated in the configuration shown in any suitable manner as, for example, by being machined from elongated bar stock or, depending upon the particular material employed, might be extruded, foamed-in-place or otherwise molded.

Extended along that attachment portion 19 of each form section 14 is a relatively wide tape strip 25, which is a two-sided or double-sided pressure-sensitive tape adhesively secured along its other side to the finish 13 of the pool wall 10. Thus, each form section 14 is adhesively secured to the upwardly extending walls 10 of the pool by means of the tape strip 25 which is substantially non-stretchable and, for example, might be a fiberglass tape or an adhesive transfer tape.

As respects the present invention, the tape employed may be anyone of a number of commercially available tapes, and a strip sufficiently wide to cover the two ribs 21 and 22 and the channel 20 defined therebetween is used as a matter of convenience and to save time, but quite evidently two separate tape strips could be employed in respective assoication with the ribs 21 and 22. It will be noted that a tape strip 26 is adhesively attached to the upper edge portion 27 of the form section 14*b* for purposes of preventing elongation thereof as it traverses an inside bend, as will be described hereinafter.

The seal 24 is a resilient member, and may be constituted a commercially available polyurethane liquid rubber spread along the upper edge 11 of the side walls 10 against the recess 23 of each form 14 in overlying relation with the moisture impervious finish 13 along such walls, and the such liquid rubber when cured becomes a resilient solid. In the particular installation illustrated, the resilient seal 24 has a width of about two inches and a thickness approximately ⅛ of an inch. The seal is adapted to accommodate slight variations and irregularities along the upper surface 11 of the side walls 10, including the finish 13 along the inner surfaces thereof and facilitates formation of a substantially water-tight seal between the relatively uniform temperature side walls and temperature-varying coping 16 which expands and contracts in accordance with the temperatures imposed thereon by the contemporary values of the ambient environment.

In use of the form sections 14 and in providing the concrete coping 16 along the upper edge of a swimming pool, the inner surfaces of the side walls of such pool are first equipped with the tile or other water-impervious finish, as shown in FIGS. 1 and 2. Each form section 14 is provided with a tape strip 25 along the attachment portion 19, and such strip may be attached at any time (such as at the construction site) by pressing one of the pressure-sensitive adhesive surfaces of the strip against the appropriate surface of the attachment portion 19. Evidently, the tape strip could be secured to the section 14 at some other time especially where adhesive transfer tapes are employed or where the opposite face of the tape strip has the adhesive thereon protected by a removable cover or coating of some type.

Each form section 14 has the opposite pressure-sensitive adhesive face of the tape strip 25 pressed against the finish 13 of the pool wall 10 with the configurated surface portion 15 of the section projecting above the upper edge 11 of the pool wall and, particularly, with the recess 23 of the section substantially aligned with the upper edge 11, as shown in FIG. 1. As many sections 14 are used as is necessary to provide a continuous form about the side walls of the pool, and the sections are abutted along their adjacent edges as shown in FIG. 3, and are readily cut to the length or lengths necessary. When all of the sections are in place, the resilient seal 24 is formed by spreading the liquid rubber along the upper edge 11 so that it overlays the finish 13 and projects into the recess 23. When the liquid rubber cures, it forms a solid resilient seal (as shown), and a moldable mass of amorphous concrete is then spread against the configurated surface portion 15 of each section 14, as shown in FIG. 2, so that such configurated sections impose the desired finished shape upon the coping 16. When the concrete mass defining the coping 16 has cured, at least to the point that it is self-sustaining, the various sections 14 are stripped from their adhesive attachment to the pool walls and are discarded for they are intended to be disposable.

The corner portions of most pools are usually slightly arcuate, and in the ordinary instance such corners are inside corners. Thus, in the case of an ordinary rectangular pool, the four corner portions thereof are each inside corners. The form section **14*b* shown in FIGS. 1 through 4 is bent so as to conform to such an inside corner portion; and in the specific corner shown in FIGS. 1 through 3, the section 14*b* traverses an arcuate distance approximating 90°. Although the form sections 14 are bendable, they are essentially deformably bendable, in contrast to being resiliently bendable; and, therefore, in traversing a bend the side of the form section having the smaller radius tends to compress and the side having the larger radius tends to elongate. Thus, in the case of the section 14*b* shown in FIG. 3, the side 28 has the smaller radius, thereby tending to compress, while the side 29** having the larger radius tends to elongate. The interstitial spaces in the form sections facilitate and accommodate such deformable compression thereof along the side of smaller radius.

Elongation of the sections 14 along one side tends to crack, tear or otherwise permanently damage the same especially along the thickest portions thereof having the greatest mass of material, and this is an undesirable occurrence. As respects inside bends, the substantially non-stretchable tape 25 disposed along the relatively thick ribs 21 and 22 is effective to constrain the same against elongation so that in traversing an inside corner defined along the walls 10 of a pool, the surface 28 is permitted to compress while the length of the surface 29 is largely constrained against elongation and has substantially no dimensional change in conforming to the arcuate corner. In order to protect the relatively thick edge portion 27 of the form section where it traverses such inside corner portion, it is equipped with a tape strip 26 that is substantially non-stretchable and therefore maintains the dimensional integrity of the edge portion 27.

Figure 5:
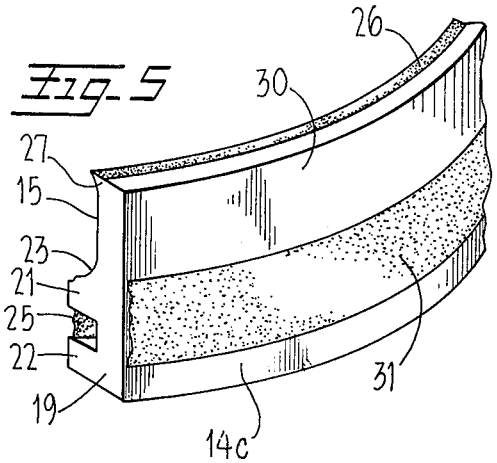
FIG. 5 is an enlarged, broken perspective view, generally similar to the perspective view of FIG. 4, but showing a form section bent in the opposite direction to conform to an outside arcuate corner portion provided along a pool.
Figure 4:
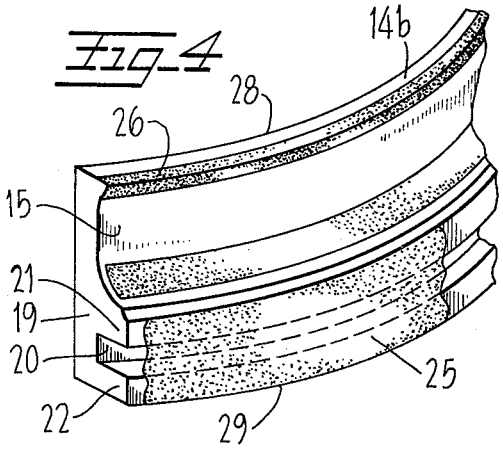
FIG. 4 is an enlarged, broken perspective view showing the reverse side of the bend of the form section shown in FIG. 3.

Each section 14 can be made to traverse an outside corner portion along the upwardly extending walls 10 of a pool, which outside corner portions are occasioned by irregularly contoured pools that may have L-shaped or T-shaped extensions, for example. The same tendency for a section to compress along one side and elongate along the other side is evidenced in traversing an outside corner portion; and to prevent such undesirable elongation, a tape strip is provided along the surface of greatest radius. Thus, in referring to FIG. 5, it is seen that the form section **14*c* shown has an outside bend formed therealong, and the surface 30 having the greater radius of curvature has a substantially non-stretchable tape strip 31 secured thereto along the attachment portion 19 thereof. It is also provided with an attachment strip 25 along the opposite surface of the attachment portion, and may be equipped with a tape strip 26 along the upper corner portion 27** thereof, which tape strip also serves to protect the relatively sharp corner portion from damage during the concrete spreading operation.

While in the foregoing specification an embodiment of the invention has been set forth in considerable detail for purposes of making a complete disclosure thereof, it will be apparent to those skilled in the art that numerous changes may be made in such details without departing from the spirit and principles of the invention.

I claim:

1. In a disposable form adapted for use in molding a concrete coping along the upper edges of the generally vertical walls of a swimming pool or the like, an integral elongated one piece form section having a surface portion thereof configurated in the finished shape to be imposed thereby upon such coping and being sufficiently stiff to confine a moldable mass of amorphous concrete in such finished shape of the coping, said form section having also an attachment portion provided with attachment surfaces facing in the same general direction as said configurated surface portion and being attachable to such vertical walls of a pool adjacent the upper edges thereof, and said form section including its attachment portion being bendable along the length thereof to enable it to conform to both inside and outside arcuate corners along any such walls of a pool.

2. The disposable form of claim 1 in which said attachment portion is provided with a longitudinally extending channel defining spaced apart ribs comprising said attachment surfaces attachable to such walls of a pool.

3. The disposable form of claim 1 in which said form section is a lightweight deformable component having interstitial spaces such that said form section tends to have a permanent set enforced thereon.

4. The disposable form of claim 3 in which said attachment portion is provided with a longitudinally extending channel defining spaced apart ribs comprising said attachment surfaces attachable to such walls of a pool.

5. The disposable form of claim 1 in combination with a swimming pool having upwardly extending walls, said form section being adhesively secured to said upwardly extending walls adjacent the upper edges thereof with said configurated surface portion of the form section projecting thereabove.

6. The disposable form of claim 5 and further comprising a double-sided pressure-sensitive tape secured to said form section and to said upwardly extending walls to adhesively secure the form section thereto.

7. In combination with a swimming pool having upwardly extending walls a disposable form adapted for use in molding a concrete coping along the upper edges of the generally vertical walls of said swimming pool or the like, an integral elongated one piece form section having a surface portion thereof configurated in the finished shape to be imposed thereby upon such coping and being sufficiently stiff to confine a moldable mass of amorphous concrete in such finished shape of the coping, said form section having also an attachment portion provided with attachment surfaces facing in the same general direction as said configurated surface portion and being attachable to such vertical walls of a pool adjacent the upper edges thereof, said form section including its attachment portion being bendable along the length thereof to enable it to conform to both inside and outside arcuate corners along any such walls of a pool, said form section being adhesively secured to said upwardly extending walls adjacent the upper edges thereof with said configurated surface portion of the form section projecting thereabove, said upwardly extending walls defining an arcuate corner therealong and said form section conforming thereto, and a substantially non-stretchable tape strip adhesively secured to said form section along the length thereof generally adjacent such arcuate corner on the side of said form section having the greater radius thereat so as to substantially constrain the same against elongation as it is bent to conform to such arcuate corner.

8. In a disposable form adapted for use in molding a concrete coping along the upper edges of the generally vertical walls of a swimming pool or the like, an integral elongated one piece form section having a surface portion thereof configurated in the finished shape to be imposed thereby upon such coping and being sufficiently stiff to confine a moldable mass of amorphous concrete in such finished shape of the coping, said form section having also an attachment portion provided with attachment surfaces facing in the same general direction as said configurated surface portion and being attachable to such vertical walls of a pool adjacent the upper edges thereof, said form section including its attachment portion being bendable along the length thereof to enable it to conform to both inside and outside arcuate corners along any such walls of a pool, and a substantially non-stretchable tape secured to said form section along the length thereof intended to be generally adjacent an outside arcuate corner of a pool wall and on the side of said form section having the greater radius thereat so as to substantially constrain the same against elongation as it is bent to conform to such outside arcuate corner.

9. The disposable form of claim 1 and further comprising a double-sided pressure-sensitive tape secured to the attachment surfaces of said form section and adapted to be secured to the aforementioned vertical pool walls to adhesively secure the form section thereto.

10. The disposable form of claim 9 in which said form section is a lightweight deformable component having interstitial spaces such that said form section tends to have a permanent set enforced thereon in conforming to such an arcuate corner portion of a pool, and in which said attachment portion is provided with a longitudinally extending channel defining spaced apart ribs comprising said attachment surfaces.

11. In combination: a substantially vertically extending pool wall terminating at the upper portion thereof in a horizontal edge; a continuous strip form of semirigid material including a mounting surface having a pressure-sensitive adhesive means secured thereto, said mounting surface fastened by said pressure-sensitive adhesive means immediately below said horizontal edge of said pool wall for temporarily securing said strip to said wall; said strip form including a form surface extending upwardly from said mounting surface to form a contoured surface for temporarily supporting concrete above said horizontal edge of said pool wall, said concrete, when set, forming a pool deck contiguous to said pool wall.

12. The combination set forth in claim 11 wherein said strip form of semirigid material comprises a continuous strip of expanded polystyrene.

* * * * *